US005198622A

United States Patent [19]

Hammarsten et al.

[11] Patent Number: 5,198,622

[45] Date of Patent: Mar. 30, 1993

[54] CONDENSER BODY FOR THE FIELD CONTROL OF THE CONNECTION OF A TRANSFORMER BUSHING

[75] Inventors: Åsa Hammarsten, Ludvika; Lannart Strandgerg, Sunnansjö; Bengt-Olof Stenestam, Ludvika, all of Sweden

[73] Assignee: Asea Brown Boveri AB, Västerås, Sweden

[21] Appl. No.: 883,919

[22] Filed: May 12, 1992

Related U.S. Application Data

[63] Continuation of Ser. No. 604,018, Oct. 26, 1990.

[30] Foreign Application Priority Data

Oct. 13, 1989 [SE] Sweden ..... 8903633-9

[51] Int. Cl.[5] ..... H01B 17/28

[52] U.S. Cl. ..... 174/143; 174/31 R; 174/73.1

[58] Field of Search ..... 174/143, 31 R, 73.1

[56] References Cited

U.S. PATENT DOCUMENTS 3,588,319 6/1971 Isogai et al. ..... 174/143

*Primary Examiner*—Leo P. Picard
*Assistant Examiner*—Hyung S. Sough
*Attorney, Agent, or Firm*—Watson, Cole, Grindle & Watson

[57] ABSTRACT

The invention relates to a condenser body for field control in transformer bushings and the connection of the body to the conductor of a transformer winding for transformers used in HVDC converter plants. The condenser body is arranged as a solid of revolution with concentrically laid condenser layers. It is formed from one end with an outwardly-directed straight frustum of a cone and from the other end with an inwardly-directed straight frustum of a cone.

2 Claims, 2 Drawing Sheets

CONDENSER BODY FOR THE FIELD CONTROL OF THE CONNECTION OF A TRANSFORMER BUSHING

This application is a file wrapper continuation application of application Ser. No. 604,018, filed 26 Oct. 1990.

TECHNICAL FIELD

The present invention relates to a special embodiment of a condenser body for field control of transformer bushings. The condenser body is designed for application substantially in connection with transformers which are cconnected to converters.

BACKGROUND ART, DISCUSSION OF THE PROBLEM

If in a vessel with transformer oil two energized electrodes are positioned at a certain distance from each other, at a certain voltage a flashover will occur between the electrodes. The flashover tendency may be minimized by inserting between the electrodes an insulator body which functions as a barrier.

Transformer bushings may comprise an upper insulator and a lower insulator of electric porcelain. At the joint between these there is a fixing flange which is connected to the transformer casing. In the centre of the bushing there is a tube on which is wound a condenser body to obtain a favourable electrical field distribution. The current can be conducted through the tube or a flexible conductor drawn through the tube.

Condenser bodies are described in a number of patent specifications and publications of various kinds. In this connection, the following may, inter alia, be mentioned, namely, EP 0032690 "Foil-insulated high voltage bushing with potential control", EP 0032687 "High-voltage bushing with layers of embossed insulating foils", EP 0051715 "Safety device for high-voltage bushing", ASEA Journal 1981, Volume 54, No. 4, pages 79–84. Common and typical for the design of the condenser bodies is that they have a central circular-cylindrical portion. From both ends this portion changes into outwardly-directed straight frustums of cones whose cross section areas have a decreasing radius.

A variant of the design of a condenser body is disclosed in GB 1,025,686, "Pothead for connecting oil-filled cables to transformers and other electrical apparatus". As above, the condenser body has a conical part terminating towards the transformer. However, towards the cable connection the condenser body terminates in a cross section area which is equal to the cross section area of the circular-cylindrical portion.

Another variant of the design of a condenser body is disclosed in a MICAFIL publication MNJ 11/12 from June 1969, in which a so-called "Re-entrant type bushing" is described. This bushing is also intended to be used only within the a.c. field. Electrically, it is built up in the same way as a conventional a.c. bushing with a condenser body made of oil-impregnated paper, Bakelite paper or is impregnated with molded resin and has concentric layers of a conducting material. The principle of the manufacture is that the transformer side of the body is first wound into an inward conical shape into a diameter where about 70% of the stress lies, whereupon the body is continuously wound into an outward conical shape into the final outer diameter with 0% of the stress. The advantage of such an embodiment is that a shorter bushing is obtained on the oil side. In addition, the shield may be omitted.

Power transformers which are used in converter plants entail special problems from the point of view of insulation, which somehow have to be overcome in order to ensure a satisfactory function.

In high voltage direct current, HVDC, plants, there is often used at least one converter per pole and station. Normally, also, several bridges are connected in series. One of the poles of a bridge is normally connected to ground and the other pole is connected to the next bridge, thus obtaining a series connection. The direct voltage potential of the respective bridge relative to ground is then increased according to the number of bridges which are connected in series.

Each bridge in the series connection is supplied with alternating voltage from a separate transformer. With increasing direct voltage potential on the bridges relative to ground, the insulation on bushings and windings on the transformers which are connected to the bridges will also be subjected to an increasingly higher direct voltage potential with a superimposed alternating voltage. The insulation of these must therefore be dimensioned so that it is capable of withstanding the increasingly higher insulating stresses to which it is then subjected.

The increasing direct voltage potential leads to special problems which do not exist in transformers used for pure alternating voltage transformation.

For converter transformers, the lower insulator of the bushing and the transition between the conductor of the transformer winding and the bushing present areas of problems from the point of view of insulation technique. This is described, inter alia, in Power Transmission by Direct Current, by E. Uhlmann, Springer Verlag 1975, pages 327–328.

The electric direct voltage field has a distribution different from that of the alternating voltage field. The distribution of the direct voltage is mainly determined by the resistivity of the various insulating mediums. It is true that both transformer oil, cellulose material and electric porcelain are good insulators, but a certain amount of electric current is conducted in these materials. The relation between the resistivity of cellulose material and transformer oil is about 100. This means that the cellulose in series with oil is subjected to considerably higher fields than the oil, which in turn, therefore, imposes demands for a sufficient amount of solid insulating material in order not to exceed the electric withstand strength. The field distribution as well as the field directions will thus be different from the case with alternating voltage. The current transport also entails a redistribution of charges in the insulating mediums used.

Because of the heavy dependence of the resistivity on moisture content, field strength, temperature, etc., the distribution of direct current is difficult to predict. In addition, the physical nature of the direct voltage, i.e. charge transport, charge, time-dependent behaviour, and so on, gives a picture of the insulation problems arising in connection with HVDC plants, which is very complex and difficult to interpret. In "Space Charge and Field Distribution in Transformers under DC-stress" by U. Gäfvert and E. Spicar, CIGRE Int. Conference on Large High Voltage Electric Systems, 1986 Session, 12–04, the complexity of the direct voltage distribution is illustrated. As previously mentioned, problems have arisen at the connection between the transformer bushing and the conductor of the transformer winding. This has led to the lower insulator of electric porcelain on the bushing having to be removed in order to manage the stresses at the HVDC terminal at the higher voltage levels.

No simple explanation of the above phenomenon has been presented. However, there are reasons to suspect that the long surfaces which arise in connection with bushings for high voltages in combination with the direction of the field along the long surfaces are of importance in this connection. Admittedly, also the alternating voltage field is directed along the surface of the lower porcelain, but its physical nature is different. One hypothesis is that the distribution of the direct voltage field runs the risk of becoming unstable and unevenly distributed along sufficiently long surfaces. Another interesting hypothesis is described in an article entitled "Effect of Duct Configuration on Oil Activity at Liquid/Solid Dielectric Interfaces" by R. E. James, E. E. Trick, R. Willoughby in Journal of Electrostatics, 12, 1982, pages 441–447. In this article it is stated that increased charge transport at surfaces caused by turbulence and access to charge is the reason for low electric withstand strength.

One way of overcoming the above problems is disclosed in U.S. patent application Ser. No. 539,209 filed Jun. 18, 1990, "Barrier of condenser type for field control in transformer bushing terminals". In this case, the transformer bushing comprises a lower insulator. To attain the desired field control, a condenser type barrier is used which has internal cones which make contact, with a certain oil gap, with the outer conical part of the lower insulator of the bushing as well as with the conically formed insulation surrounding the conductor of the transformer.

SUMMARY OF THE INVENTION, ADVANTAGES

As has been described above, the invention relates to a condenser body for field control in transformer bushings for transformers used in converter plants. The task of the condenser body is to overcome the flashovers which - as it has proved - may arise in transformer bushing terminals. It is designed so as to function as a barrier with both capacitive and resistive control of the electric field and is dimensioned so that the condenser body withstands the voltages and fields occurring in this bushing and in particular in the sensitive region at the connection between the conductor of the transformer and the bushing.

It is assumed that the conductor coming from the transformer winding, and which is to be connected to the conductor of the bushing, is surrounded by a conducting tube which is covered by wound electrical insulation. This insulation is formed, from the end of the conducting tube, as a straight frustum of a cone with cross section areas with an increasing radius which then changes into a circular-cylindrical portion towards the transformer. The conductor of the bushing also often consists of a conducting tube.

That part of the condenser body which is situated on the air side of the transformer bushing is formed as a conventional condenser body. This means that, counting from the fixing flange of the transformer bushing, it has a circular-cylindrical portion which changes into an outwardly-directed straight frustum of a cone. Also other embodiments of this portion may be used.

That part of the condenser body which is covered by the invention, i.e. on the oil side of the transformer bushing, normally counting from the fixing flange of the bushing, starts with a circular-cylindrical portion and ends in an inwardly-directed straight frustum of a cone. The axial length of the circular-cylindrical portion which is located on the oil side of the bushing is largely adapted such that its end coincides with the transition from conical to circular-cylindrical portion of the insulation of the conductor coming from the transformer winding. The conicity of the cone, which from that point is directed inwards, largely coincides (see, however, below) with the conicity of the insulation of the conductor of the transformer winding with space for an intermediate oil gap.

Such a design of a condenser body means that a conventional condenser body is integrated with a condenser type barrier. This causes the electric field to be controlled in the desired way while at the same time obtaining a shielding of the conductor of the transformer. In this way the condenser body according to the invention serves as an insulation barrier both for direct voltage and alternating voltage fields.

Otherwise, the condenser body according to the invention is built up as a conventional condenser body, i.e. it consists of wound insulating material with condenser layers of foil type concentrically inserted therein. The inner radius of the condenser body corresponds to the outer radius of the continuous current-carrying tube of the transformer bushing.

As mentioned above, the condenser body is manufactured from an insulating agent alternating with conducting layers to obtain the desired capacitive control of-the electric alternating field. The innermost condenser layer which is concentric with the conductor has an axial length which approximately corresponds to the inner axial length of the condenser body. Outside of this there are concentric layers alternating in a radial direction and tapering in an axial direction. The taper is made so that, concurrently with increasing radius of the condenser body counting from the first layer, the layers are laid in an axial direction such that their outer edges connect with the outwardly-directed straight frustum of a cone of the condenser body on one side - the air side - and an evenly decreasing taper counting from the first layer towards the fixing flange on the other side. In addition there are short layers which are laid such that, concurrently with increasing radius of the condenser body counting from the first innermost layer, they are laid in an axial direction such that their outer edges connect with the inwardly-directed straight frustum of a cone of the condenser body. The axial length of these short layers is adapted such that their area is constant, i.e. the axial length decreases with increasing radius of the condenser body.

To obtain the desired field control, the innermost layer is connected to the central conducting tube, to which high voltage is applied, and the outermost layer at the fixing flange is connected to ground.

As mentioned above, the direct voltage field is controlled by several factors. Thus, for example, the medium that has the lowest resistivity is field-controlling. Between the insulator body and the surrounding inwardly-directed straight frustum of a cone of the condenser body, an oil gap is formed, as already mentioned. Since the oil has lowest resistivity, most of the current is conducted in the oil gap, which therefore controls the field in parallel with surrounding surfaces. To obtain an even distribution of the field along these surfaces, it is therefore important that the width of the oil gap increases with decreasing radius. Otherwise, the field would be concentrated towards that part where the radius is smallest, i.e. where there is the smallest axial cross session area. Therefore, the conicity of the inwardly-directed straight frustum of a cone of the condenser body and the conicity of the conical portion of the insulator body are suitably chosen such that the radial cross section area of the oil gap becomes approximately the same along the conical portion of the bodies.

Another field-controlling part is the radial distribution of the field in that part of the condenser body which does not contain any layers, i.e. around the innermost layer to which high voltage is applied. Between the oil gap towards the insulation on the conductor of the transformer winding and this region, the conducting layers function—in the direct voltage case—as equipotential lines which prevent the field from being concentrated to any part of the mentioned oil channel. With an accurately formed oil channel, the above-mentioned factors cooperate to obtain an even distribution of the field in the oil the field being guided over, in the desired manner, to the insulation on the conductor of the transformer winding.

It is exceedingly desirable that the oil systems in the transformer and in the bushing consist of separate systems. to achieve this, two different principal embodiments of the condenser body exist. These will be described in greater detail under the "Description of the preferred embodiments", and therefore only a brief description of the principle will be given here. One alternative is that the condenser body is designed as a tight unit, for example impregnated and cured with some suitable cast compound. The second alternative comprises enclosing the condenser body in a tight casing and leads to the creation of two oil gaps at the transition between the insulation of the conductor of the transformer winding and the condenser body.

One advantage of the condenser body with the integrated condenser type barrier according to the invention in relation to the concept with a separate condenser type barrier disclosed in U.S. application Ser. No. 539,209 filed Jun. 18, 1990 is that the outer dimensions of the system can be made smaller. Another advantage is that the extent of the interfaces which are subjected to tangential field stress is reduced.

DESCRIPTION OF THE PREFERRED EMBODIMENTS

Figure 1:
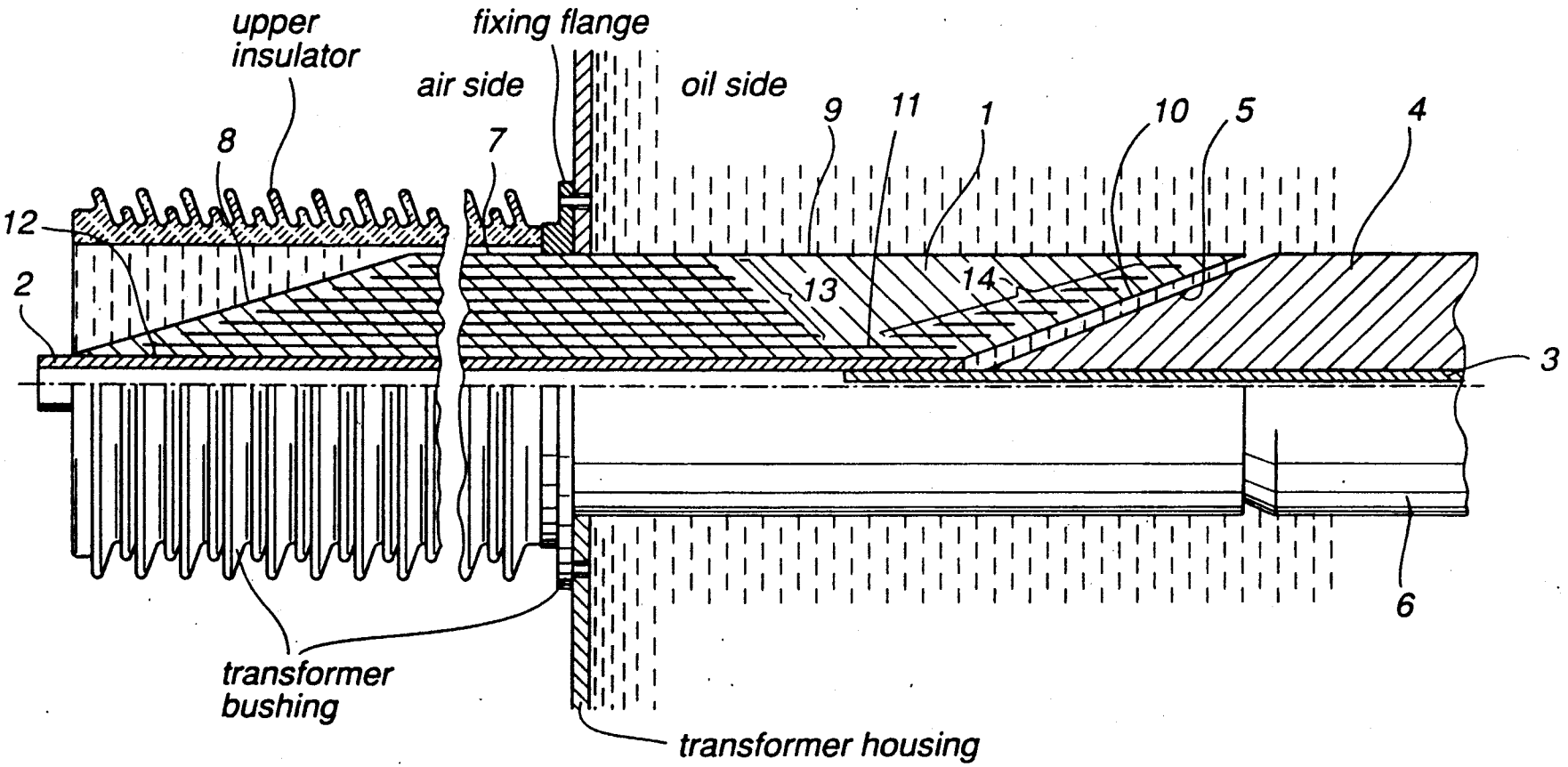
FIGS. 1 and 2 are crosssectional views showing two alternative embodiments of a condenser body according to the invention. To show the invention in the best way, the proportions between the diameter and axial length of the condenser body are not according to scale. The same is true also of the conicity of the cones.

The principal embodiment where the condenser body is formed as a tight cast unit is shown in FIG. 1. As has been described, the condenser body 1 is built up as a solid of revolution which consists of wound insulating material with concentrically inserted foil-type condenser layers. In order to show the condenser body 1 to a certain extent in its proper context, FIG. 1 also shows the central current-carrying part 2, in the form of a tube, around which the condenser body 1 is centered, as well as the conductor of the transformer consisting of an inner energized tube 3 and insulating material 4 wound thereon, which material 4 has a conical taper 5 towards the tube end and then changes into a circular-cylindrical part 6.

A transformer bushing in which a condenser body according to the invention is to be included normally has an upper insulator of electric porcelain acting towards the air side. On the oil side transformer bushings normally also have a lower insulator of, for example, electric porcelain. In an embodiment according to the invention, on the other hand, there is no such lower insulator of conventional type.

The condenser body in the first alternative is impregnated with a suitable cast compound, for example epoxy. The condenser body is then wound from, for example, an insulation paper which is impregnable by the cast compound used.

On the air side the condenser body is formed as a condenser body according to the state of the art, i.e. with a circular-cylindrical part 7 which changes into an outwardly-directed straight frustum of a cone 8. On the oil side the condenser body continues in a circular-cylindrical part 9 with the same outside diameter as the circular-cylindrical part on the air side. The axial length of the outer contour of the circular-cylindrical part is adapted such that its end coincides with the transition of the insulation from the conical to the circular-cylindrical part of the conductor of the transformer winding. From the end of the condenser body there extends an inwardly-directed straight frustum of a cone 10 with a conicity-which, according to the method previously described, somewhat deviates from the conicity of the conductor of the transformer winding. This leads to the creation of an oil gap between the condenser body and the conical part 5 of the insulating material 4 of the conductor of the transformer winding. It is important for the distribution of the direct voltage field that the oil gap between the inwardly-directed straight frustum of a cone of the condenser body and the conical part of the insulating material 4 of the conductor of the transformer winding should have largely the same radial cross section along the whole outer contour of the cones. The difference in radius is therefore greatest at the smallest base surfaces of the cones.

The first and innermost condenser layer 11 is electrically connected to the current-carrying tube 2 of the bushing, as indicated at the point of connection 12. This first layer has an axial length which corresponds to the inner axial length of the condenser body. It is surrounded by concentric layers 13 which are laid one above the other in a radial direction and tapering relative to the first layer in an axial direction. The taper is done by laying the layers, concurrently with increasing radius, in an axial direction so that the outer edges on one side connect with the conical contour of the air side and with an evenly decreasing taper towards the fixing flange of the transformer bushing on the other side. The outermost of these layers is connected to ground potential.

Furthermore, the condenser body is provided with concentric short layers 14 which connect with the contour of the inwardly-directed straight frustum of a cone. The axial length of these short layers is adapted so as to have a practically constant area independently of the radius on which they are situated.

Figure 2:
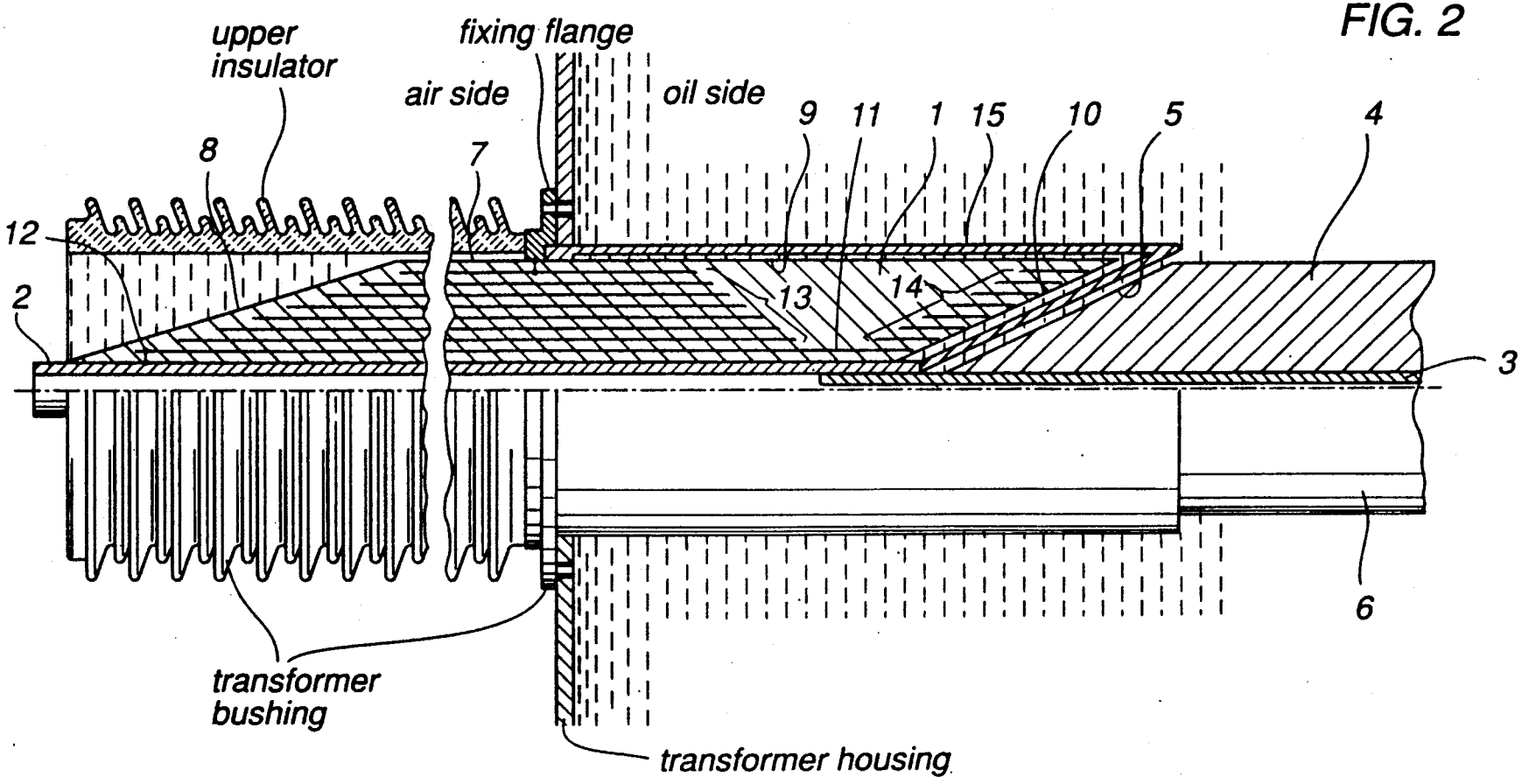

An embodiment of a condenser body according to the abovementioned second alternative is shown in FIG. 2. The wound insulating material and the layers, are arranged, from the design point of view, in the same way as in FIG. 1. However, in this embodiment the insulation part consists, for example, of oil-impregnated insulation paper. In this alternative the entire condenser body on the oil side is surrounded by oil enclosed in a tight casing 15. This leads to the creation of two oil gaps between the inwardly-directed cone of the condenser body and the conical part of the insulating material 4 of the conductor of the transformer winding, i.e. inside and outside the tight casing, respectively. Both of these gaps must now be dimensioned in the same way as the oil gap in FIG. 1. The demands that need to be placed on the material in this casing are that it must have sufficient mouldability and that its resistivity is to be greater than or at least as great as the resistivity of the oil.

We claim:

1. In combination, a condenser body and a transformer bushing, the condenser body being for the field control of the connection of a transformer bushing, said condenser body being formed as a solid of revolution with an inner circular-cylindrical opening the radius of which correspondes to the outer radius of a central current-carrying tube of the transformer bushing and which on the air side of the transformer bushing having a circular-cylindrical outer part terminating in a straight outwardly-directed truncated conical part, insulating material with foil-type condenser layers concentrically laid therein, the condenser body on the oil side of the transformer bushing having a circular-cylindrical inner opening corresponding to the inner opening of the air side and an outer circular-cylindrical part, which from an end thereof is an inwardly-directed straight frustum of a cone facing towards said inner opening, the transformer bushing comprising an energized tube surrounded by said insulating material, said insulating material having a circular-cylindrical part and a straight conical taper towards the end of the tube, said insulating material being positioned around the conductor of the transformer winding, and the conicity of the inwardly-directed straight frustum of a cone of the condenser body being positioned so that the radial cross section area of the gap formed therebetween and the conical part of the insulating material around said energized tube is constant along the entire length of the inwardly-directed cone.

2. A condenser body for the field control of the connection of a transformer bushing, said condenser body being formed as a solid of revolution with an inner circular-cylindrical opening the radius of which correspondes to the outer radius of a central current-carrying tube of the transformer bushing and which on the air side of the transformer bushing has a circular-cylindrical outer part terminating in a straight outwardly-directed truncated conical part, insulating material with foil-type condenser layers concentrically laid therein and the condenser body on the oil side of the transformer bushing having a circular-cylindrical inner opening corresponding to the inner opening of the air side and an outer circular-cylindrical part, which from an end thereof is an inwardly-directed straight frustum of a cone facing towards said inner opening, said condenser body further comprising a first inner condenser layer having an axial length corresponding to the axial length of said inner circular-cylindrical opening, concentric condenser layers being laid outside of said first inner condenser layer, one above the other, in a radial direction and tapering in an axial direction relative to the condenser body so that the condenser layers, concurrently with increasing radius of the condenser body counting from the first layer, being laid in an axial direction such that the outer edges thereof connect with the straight outwardly-directed frustum of a cone of the condenser body on one side and an evenly decreasing taper counting from the first layer towards the other side, short condenser layers, concurrently with increasing radius of the condenser body counting from the first layer, being laid in an axial direction so that the outer edges thereof connect with the inwardly-directed straight frustum of a cone of the condenser body and the axial length of said short condenser layers being such that the area thereof is constant.

* * * * *